United States Patent [19]

Maeda

[11] 4,403,950

[45] Sep. 13, 1983

[54] FIXING DEVICE

[75] Inventor: Michio Maeda, Ooiso, Japan

[73] Assignee: Tokyo Shibaura Denki Kabushiki Kaisha, Kawasaki, Japan

[21] Appl. No.: 419,604

[22] Filed: Sep. 17, 1982

[30] Foreign Application Priority Data

Oct. 9, 1981 [JP] Japan ..... 56-150294[U]

[51] Int. Cl.[3] ..... G03G 15/20

[52] U.S. Cl. ..... 432/60; 118/60; 118/101; 118/666

[58] Field of Search ..... 432/60; 118/60, 666, 118/101; 219/469; 355/3 FU

[56] References Cited

U.S. PATENT DOCUMENTS 3,951,585 4/1976 Fujimoto ..... 432/60 X 4,232,959 11/1980 Ateya et al. ..... 432/60 X

*Primary Examiner*—Evan K. Lawrence

*Attorney, Agent, or Firm*—Cushman, Darby & Cushman

[57] ABSTRACT

A fixing device comprises a first rotatable roller in a fixed position, a heater provided in the first rotatable roller for heating the same, and a second rotatable roller facing the first rotatable roller and capable of being in contact therewith. The second rotatable roller is supported movably by shifting members. Each shifting member separates the second rotatable roller from the first roller at normal temperature and presses the second roller against the first rotatable roller when the shifting member is deformed by heat from the first roller heated by the heater.

7 Claims, 6 Drawing Figures

FIXING DEVICE

BACKGROUND OF THE INVENTION

This invention relates to a fixing device for fixing onto a copying paper a toner image which is transferred from a photosensitive body to the copying paper, more specifically to a fixing device for fixing a toner image onto a copying paper by heating and pressurizing operations.

In a conventional electrostatic copying apparatus, for example, a fixing device for fixing an unfixed toner image is so constructed that resinous powder in the toner is melted by heating and pressurized to be fixed onto a copying paper. In this fixing device, while the copying paper is held under a given pressure between a pair of rollers at least one of which is covered with a heat-resisting elastic material, such as silicone rubber, for a sufficient nip width, the toner image is heated by a heater contained in one of the rollers. If the rollers are left pressed against each other, the elastic material will suffer permanent deformation. As a result, dents will be formed in the surfaces of the rollers to cause partially inadequate pressurization during rotation of the rollers, which will lead to defective fixation or excessive noise.

Whereupon, there was developed a fixing device 10 as shown in FIG. 1. The fixing device 10 has a pair of pressure rollers 14*a* and 14*b* facing each other with a conveyor path 12 between them. The one roller 14*a* can touch and leave the other roller 14*b*, and contains a heater 16 therein. The roller 14*a* is connected with a pressure spring 18 for urging the roller 14*a* toward the roller 14*b*, and a pressure release mechanism 20 for optionally separating the roller 14*a* from the roller 14*b* against the urging force of the pressure spring 18. The fixing device of this type, however, is complicated in construction, and requires a delay mechanism which is intended to release pressure if the power supply is cut while the rollers are rotating.

SUMMARY OF THE INVENTION

This invention is contrived in consideration of these circumstances, and is intended to provide a fixing device simple in construction and capable of improved fixation, allowing pressure rollers to perform a pressurizing operation only while they are being heated.

According to an aspect of this invention, there is provided a fixing device which comprises a first rotatable roller in a fixed position, heating means provided in the first roller for heating the same, a second rotatable roller facing the first roller and capable of being in contact therewith, and shifting means movably supporting the second roller. The shifting means separates the second roller from the first roller at normal temperature, and presses the same against the first roller when the shifting means is deformed by heat from the first roller heated by the heating means.

DETAILED DESCRIPTION OF THE PREFERRED EMBODIMENTS

There will now be described in detail a fixing device of a first embodiment according to this invention with reference to the accompanying drawings of FIGS. 2 to 4.

Figure 1:
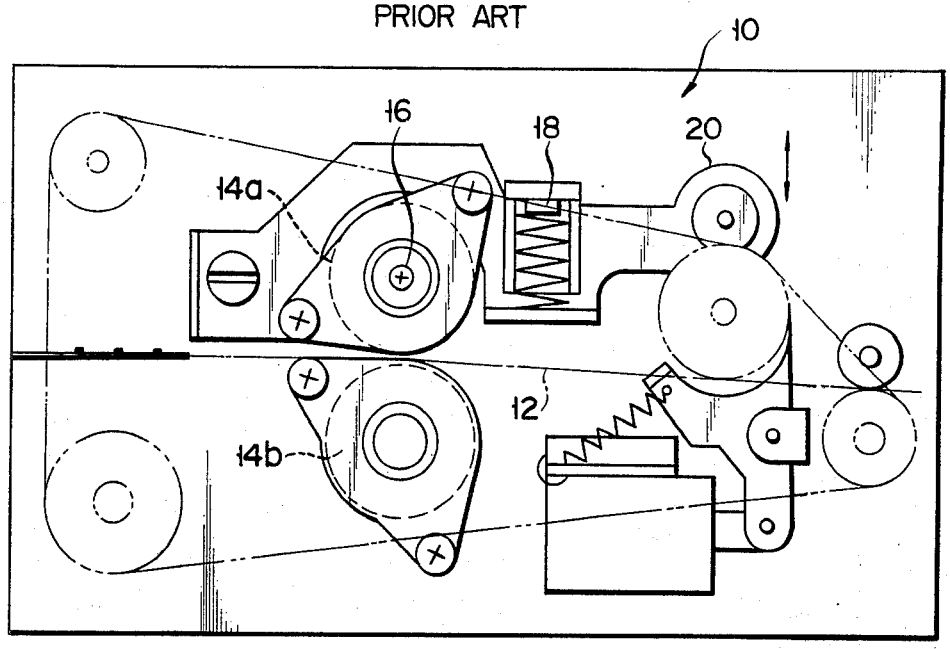
FIG. 1 PRIOR ART
FIG. 1 is a front view schematically showing a prior art fixing device.
Figure 2:
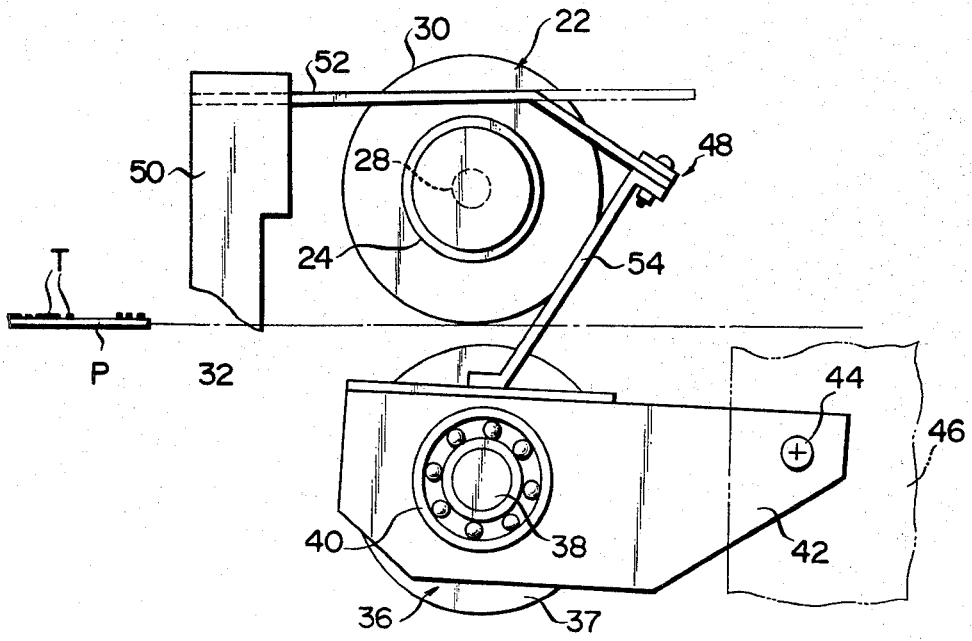
FIG. 2 is a front view showing a fixing device of a first embodiment according to the present invention in a non-fixing state.
Figure 3:
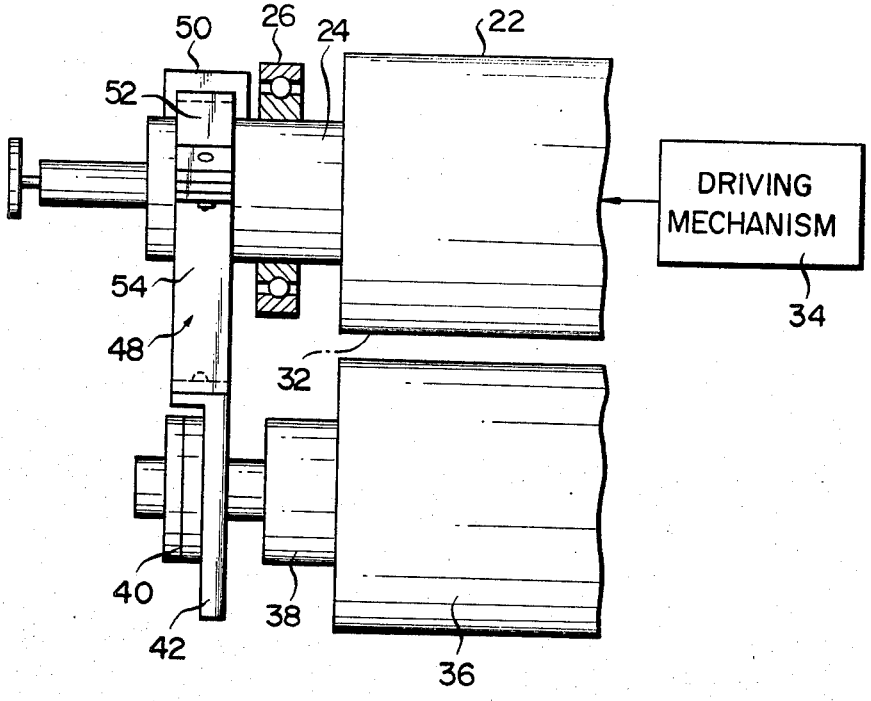
FIG. 3 is a partial side view of the fixing device shown in FIG. 2.
Figure 4:
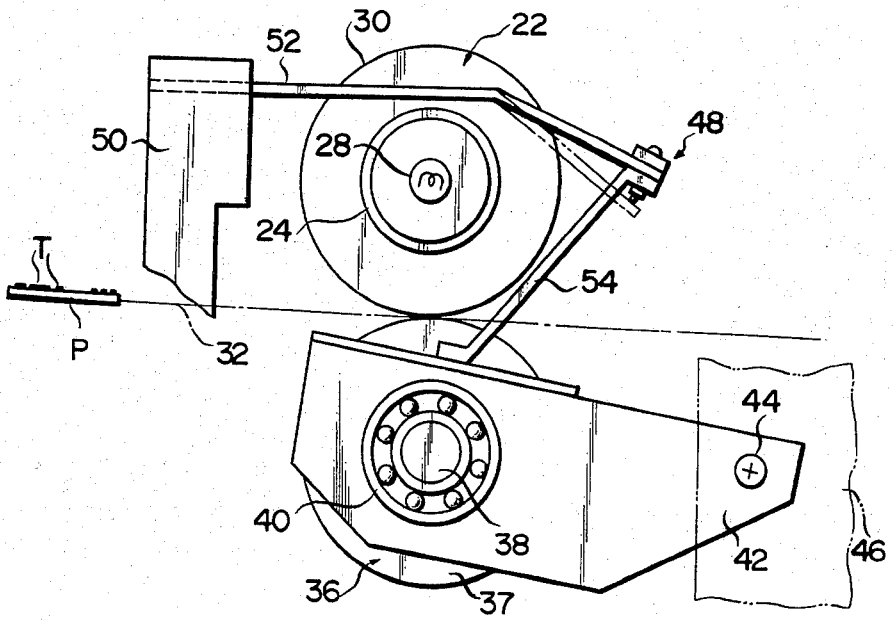
FIG. 4 is a front view showing the fixing device of FIG. 2 in a fixing state.

In FIGS. 2 to 4, reference numeral 22 designates a rotatable first roller having a shaft 24 coaxial therewith. Both ends of the shaft 24 are individually rotatably supported by bearings 26 fixed to a frame (not shown). The first roller 22 contains therein a heater 28 as heating means, whereby the whole body of the first roller 22 is heated. For example, the heater 28 produces heat of approximately 300° C., whereby the outer peripheral surface of the first roller 22 is heated to about 200° C. The outer peripheral surface of the first roller 22 is covered with a surface layer 30 made with offset preventing material with high heat-resistance, such as TEFLON (TRADE MARK). The shaft 24 is formed of metal with high thermal conductivity, and is heated as the first roller 22 is heated. The lower end of the first roller 22 is in contact with a conveyor path 32 for copying paper P to which unfixed toner T is attached. The first roller 22 is rotated by a drive mechanism 34 shown in FIG. 3.

A second roller 36 having a shaft 38 coaxial therewith is rotatable disposed under the first roller 22. The outer peripheral surface of the second roller 36 is covered with a surface layer 37 formed of an elastic material with a good heat-resisting property, e.g., silicone rubber. The second roller 36 can move between a first position where it is at a given distance from the first roller 22 and a second position where it is in rolling contact with the first roller 22 with the conveyor path 32 between them. Both ends of the shaft 38 are rotatably supported on the distal end portions of a pair of swinging arms 42 by means of bearings 40, respectively. The proximal end portion of each swinging arm 42 is swingably mounted on a supporting plate 46 by means of a pivot 44.

A regulating member 48 for regulating the rocking position of each arm 42 around its corresponding pivot 44 connects the distal end portion of the arm 42 with a frame 50. The regulating member 48 includes a shifting member 52 with one end fixed to the frame 50, and a coupling member 54 with one end fixed to the distal end portion of the arm 42. The other ends of the shifting member 52 and coupling member are fixed to each other. The shifting member 52 is so designed as to pass just over the shaft 24 of the first roller 22. Thus, the shifting member 52 is heated by heat generated from the first roller 22.

The shifting member 52 is formed into a plate from an alloy having a thermoelastic martensite modification property. The shifting member 52 is so formed that it is bent downward in the middle as indicated by solid line in FIG. 2 when it assumes a martensite phase at normal-temperature, and that it straightens itself as indicated by the two-dot and a dash line in FIG. 2 when it assumes mother phase at high-temperature. The shifting member 52 locates the second roller 36 in its first position at normal temperature and in its second position at high-temperature. The shifting member 52 reversibly changes its shape according to temperature changes.

In the present first embodiment, the shifting member 52 is formed of NITINOL (tradename). The NITINOL is formed of what is called a bidirectional shape memory alloy of nickel and titanium with a molecular weight ratio of 50:50. The NITINOL shifts from the martensite phase to the mother phase at a temperature of 50° C. to 80° C., and takes a memorized shape in the mother phase.

There will now be described the operation of the fixing device constructed in the aforementioned manner.

In the non-fixing state, the heater 28 is not energized and does not produce heat. Accordingly, the shifting member 52 of the regulating member 48 is not heated, but is kept in the martensite phase at normal temperature. Thus, the second roller 36 is held in its first position, keeping itself away from the first roller 22. With this arrangement, the second and first rollers 36 and 22 are not pressed against each other and are not, therefore, in danger of permanent deformation in the non-fixing state.

When an instruction for operation is given, that is, turning on of a main switch (not shown), the heater 28 is energized to produce heat. Accordingly, the first roller 22 is heated from within. This heat is transmitted to both the surface layer 30 and the shaft 24 of the first roller 22. Then, the shaft 24 is heated, so that the shifting member 52 located close to the shaft 24 is heated by heat transmission through the air. The heater 28 is on-off controlled so that a constant fixing temperature is maintained by a control device (not shown) after the temperature of the surface layer 30 of the first roller 22 reaches a necessary fixing temperature level for fixing the toner T.

The heated shifting member 52 shifts from the martensite phase to the mother phase, then it is urged to restore the memorized shape. Accordingly, the second roller 36 is moved from the first position to the second position by means of the coupling member 54 to be brought into rolling contact with the first roller 22. Since the shifting member 52 gains elasticity as it assumes the mother phase, the second roller 36 is pressed against the first roller 22 under a given pressure. This makes the fixing device ready for operation so that the heater 28 is energized to produce heat. Thus, the toner T on the copying paper P passed through the conveyor path 32 and held between the nip portions of the rollers 22 and 36 is fixed securely to the copying paper P, subjected to the pressurization as well as the heating effect.

When the copying operation is completed, the heater 28 is disconnected from the power supply. Then the shifting member 52 ceases to be heated, and is cooled to the normal temperature. Accompanying this temperature change, the shifting member 52 comes to assume the martensite phase, so that the second roller 36 is moved from the second position to the first position to be separated from the first roller 22. Thus, the rollers 22 and 36 are protected against permanent deformation due to a prolonged non-operating state.

According to the first embodiment, as described above, while the heater 28 is producing heat, the shifting member 52 is kept at high temperature and in the mother phase, so that the second roller 36 is pressed against the first roller 22. While the heater 28 is not producing heat, the shifting member 52 is kept at normal temperature and in the martensite phase, so that the second roller 36 is kept apart from the first roller 22. Unlike the prior art fixing device, therefore, the fixing device is simple in construction, requiring no pressurizing mechanism, pressure release mechanism, or delay mechanism. Utilizing the heat for fixation, moreover, the fixing device requires no special drive source for shifting the second roller 36 to achieve pressure contact, and thus saves energy.

The pressure under which the second roller 36 is pressed against the first roller 22 can be set optionally by changing the shape of the shifting member 52 or by adjusting the gap between the second roller 36 in its first position and the first roller 22.

This invention is not limited to the construction of the aforementioned first embodiment, and various changes and modifications may be effected therein by one skilled in the art without departing from the scope or spirit of the invention.

In the first embodiment, the nickel content by molecular weight of the NI-Ti alloy used for the shifting member 52 is defined as 50%. The same effect may be obtained if the content is set within a range of 49% to 51%.

The shifting member 52 is located close to the shaft 24 in the first embodiment with air between them. Alternatively, a member with high thermal conductivity and small coefficient of friction may be interposed between the shaft 24 and the shifting member 52.

Figure 5:
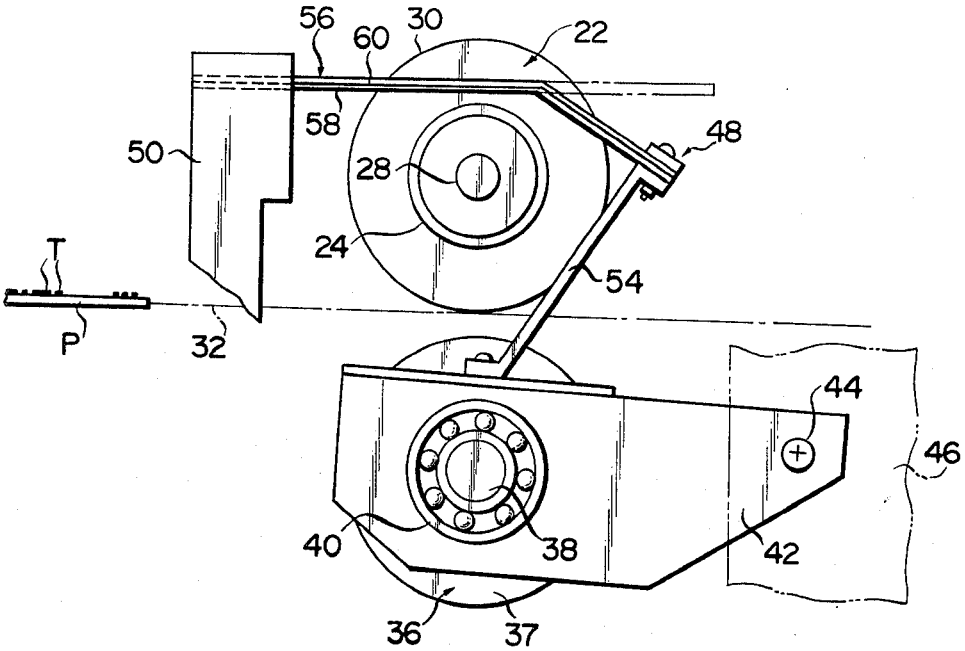
FIG. 5 is a front view showing a fixing device of a second embodiment according to the present invention.

In the first embodiment, moreover, the Ni-Ti alloy used for the shifting member 52 has a thermoelastic martensite modification property. However, the shifting member 52 may be formed of any other suitable material which can separate the second roller 36 from the first member 22 at normal temperature, and can press the second roller 36 against the first roller 22 at high temperature. As shown as a second embodiment in FIG. 5, for example, the shifting member 56 may be formed of bimetal with the same effect. In this case, the shifting member 56 includes a first layer 58 with higher thermal expansivity closer to the second roller 36, and a second layer 60 with lower thermal expansivity fixed to the first layer 58 over the entire length and located farther from the second roller 36. The first layer 58 is formed of e.g. Invar (trademark), while the second layer 60 is formed of e.g. brass. The shifting member 56 formed of such bimetal is heated to bend upward due to the difference in thermal expansivity between the two layers 58 and 60. Thus, the second roller 36 is pressed against the first roller 22 as the latter is heated.

Figure 6:
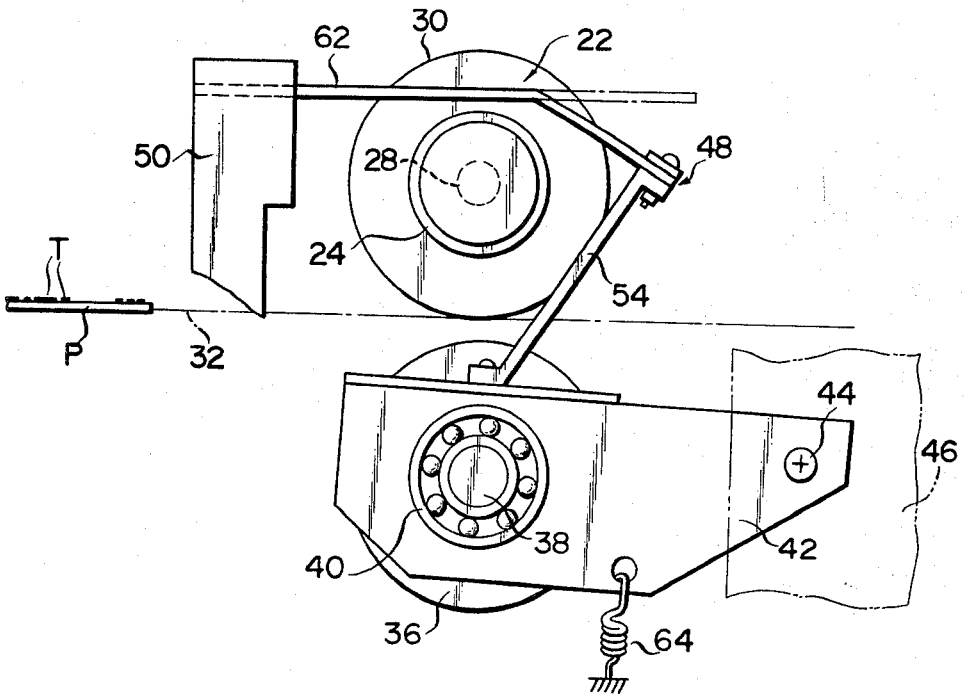
FIG. 6 is a front view showing a fixing device of a third embodiment according to the present invention.

In the first embodiment, a bidirectional shape memory alloy is used as the material having the thermoelastic martensite modification property. Alternatively, as shown as a third embodiment in FIG. 6, a unidirectional shape memory alloy may be used for this purpose. In this case, a shifting member 62 moves from its first position to its second position to take a memorized shape when it assumes the mother phase at high temperature. When the normal temperature is restored, the shifting member 62 returns from the second position to the first position by the agency of a spring 64. Thus, the third embodiment may produce the same effect as the first embodiment.

What is claimed is:

1. A fixing device comprising:

a first rotatable roller in a fixed position;

heating means provided in the first roller for heating the same;

a second rotatable roller facing the first roller and capable of being in contact therewith; and shifting means deformable by heat from the first roller and movably supporting the second roller for separating the second roller from the first roller at normal temperature, and for pressing the second roller against the first roller when the shifting means is deformed by heat from the first roller heated by the heating means.

2. The fixing device according to claim 1, wherein said first roller includes shafts having high thermal conductivity at both ends of the roller and an offset preventing layer on the outer peripheral surface of the roller, said shafts being heated by the heating means;

said second roller includes shafts at both ends; and said shifting means includes a pair of shifting members each rotatably supporting the shafts of the second roller and located close to the shafts of the first roller, the second roller being separated from the first roller at normal temperature, and being pressed against the first roller when the shifting members are deformed by heat from the shafts of the first roller heated by the heating means.

3. The fixing device according to claim 2, wherein each said shifting member is formed of a material having a thermoelastic martensite modification property.

4. The fixing device according to claim 3, wherein each said shifting member is formed of a bidirectional shape memory alloy.

5. The fixing device according to claim 4, wherein said bidirectional shape memory alloy assumes at normal temperature a martensite phase and such a shape that the second roller is separated from the first roller, and assumes at high temperature a mother phase and such a shape that the second roller is pressed against the first roller.

6. The fixing device according to claim 3, wherein each said shifting member is formed of a unidirectional shape memory alloy for assuming at high temperature a mother phase and such a shape that the second roller is pressed against the first roller; and which further comprises urging means for urging the second roller to move away from the first roller.

7. The fixing device according to claim 2, wherein each said shifting member includes a bimetal for assuming at normal temperature a shape for separating the second roller from the first roller and for assuming at high temperature a shape for pressing the second roller against the first roller.

* * * * *